US010683862B2

(12) United States Patent
Ladd et al.

(10) Patent No.: US 10,683,862 B2
(45) Date of Patent: Jun. 16, 2020

(54) HOUSING FOR HIGH-PRESSURE FLUID APPLICATIONS

(71) Applicant: SERVA GROUP LLC, Oklahoma City, OK (US)

(72) Inventors: Bill Ladd, Tulsa, OK (US); Tang Jun, Jingzhou (CN); Wang Cheng Cai, Jingzhou (CN)

(73) Assignee: SERVA GROUP LLC, Oklahoma City, OK (US)

( * ) Notice: Subject to any disclaimer, the term of this patent is extended or adjusted under 35 U.S.C. 154(b) by 39 days.

(21) Appl. No.: 15/991,618

(22) Filed: May 29, 2018

(65) Prior Publication Data

US 2018/0274536 A1 Sep. 27, 2018

Related U.S. Application Data

(63) Continuation of application No. 14/915,574, filed as application No. PCT/US2014/048941 on Jul. 30, 2014, now Pat. No. 9,989,053.

(60) Provisional application No. 61/875,972, filed on Sep. 10, 2013.

(51) Int. Cl.

| | |
|---|---|
| ***F04B 53/16*** | (2006.01) |
| ***F04B 47/00*** | (2006.01) |
| ***F04B 53/10*** | (2006.01) |

(52) U.S. Cl.

CPC ..... *F04B 53/162* (2013.01); *F04B 47/00* (2013.01); *F04B 53/10* (2013.01); *F04B 53/16* (2013.01)

(58) Field of Classification Search

CPC ..... F04B 53/10; F04B 53/16; F04B 53/162; F04B 47/00

See application file for complete search history.

(56) References Cited

U.S. PATENT DOCUMENTS

| | | | | |
|---|---|---|---|---|
| 6,623,259 | B1 | 9/2003 | Blume | |
| 7,186,097 | B1 | 3/2007 | Blume | |
| 7,364,412 | B2 | 4/2008 | Kugelev et al. | |
| 7,484,452 | B2 | 2/2009 | Baxter et al. | |
| 7,513,759 | B1 | 4/2009 | Blume | |
| 8,147,227 | B1 | 4/2012 | Blume | |
| 2012/0288387 | A1* | 11/2012 | Freed | F04B 53/10 417/454 |
| 2013/0216413 | A1 | 8/2013 | Bayyouk et al. | |

OTHER PUBLICATIONS

PCT/US20141048941, Serva Group LLC, Internationai Search Report dated Nov. 24, 2014, pp. 1-6.

* cited by examiner

*Primary Examiner* — Thomas E Lazo
(74) *Attorney, Agent, or Firm* — McAfee & Taft

(57) ABSTRACT

A housing for use in high-pressure fluid applications, and in particular a structure for the fluid end of a multi-cylinder reciprocating pump used in oilfield, wherein the structure includes features such as ruled surfaces and increased side-wall thickness to improve resistance to stress applied and has an extended the service life.

7 Claims, 9 Drawing Sheets

HOUSING FOR HIGH-PRESSURE FLUID APPLICATIONS

CROSS-REFERENCE TO RELATED APPLICATIONS

This application is a continuation of U.S. application Ser. No. 14/915,574 filed Feb. 29, 2016, now allowed, which is a national stage filing of PCT Application PCT/US2014/048941 filed Jul. 30, 2014, which claims the benefit of U.S. Provisional Application No. 61/875,972 filed Sep. 10, 2013, which are all hereby incorporated by reference.

TECHNICAL FIELD

The present invention relates generally to the structure for the fluid end of a multi-cylinder reciprocating pump used in oilfields. More specifically, the present invention relates to fluid end structures that reduce the effective stress applied and extend the service life of the fluid end.

BACKGROUND

Since the first experimental use in 1947, hydraulic fracturing, commonly known as fracking, has been gradually adopted for the stimulating treatment of oil wells and has become a great success in the past twenty years, especially in North America. High pressure pumping systems to propel the fracturing fluid into the wellbore is critical to successful fracking operations. The key component of such systems is a high pressure reciprocating plunger pump, comprising a power end and fluid end, which has been widely used in oilfield applications for several decades. The power end converts the rotation of a drive shaft to reciprocating motion of a plurality of plungers. The reciprocation motion of the plungers, in association with the operation of valves within the fluid end, produces a pumping process due to the volume evolution within the fluid end. Typically, the fluid end is comprised of a pump housing, valves and valve seats, plungers, seal packings, springs and retainers. The pump housing has a suction valve in the suction bore, a discharge valve in the discharge bore, an access bore and a plunger in the plunger bore. In the suction stroke, the plunger retracts along the bore and causes a quick decrease of the inner pressure; thus, the suction valve is opened and the fluid is pumped in due to the pressure difference between the suction pipe and the inner chamber. In the forward stroke, the hydraulic pressure gradually increases until it is large enough to open the discharge valve and thus pump the compressed liquid into the discharge pipe.

The pump housing is cyclically strained during the reciprocating motion of plungers. The cyclic hydraulic pressure causes the initiation of fatigue crack in the intersecting bores of the pump housing made of high-strength forged steels. Severe wear can also be observed in the cross-bores of fluid end after the operation, causing the leaking or emission of the fluid.

Additionally, the fracking fluid injected into the wellbore at high pressure generally contains fracture sand, chemicals, mud and/or cement. These chemicals are used to accelerate the formation of cracks in reservoirs and the small grains of sands hold formed cracks open when hydraulic pressure is removed, but these additives also accelerate the damage of the components of the high pressure pumping system, which are already under heavy duties, and bring challenges to the pump manufactures.

Nowadays, hydraulic fracturing has changed along with the rapid exploitation of shale gas in more complex geological formations to ensure energy supply worldwide. The evolution of high pressure pumps has occurred throughout the development of hydraulic fracturing with the increase of both pressure capabilities and flow rate. Conventional fracturing operations in gas wells require only one or two fracturing stages to complete the stimulation process of a vertical well, and the required pressure is most often less than 10,000 psi; thus, the pump using a simple design is capable of meeting the demands. However, the pumping environment becomes harsher when the unconventional resources (e.g., Barnett Shale and Haynesville Shale) are commercially developed with horizontal drilling techniques in the past decade. The stimulation process requires higher pumping pressure (up to 13,500 psi) and much longer pumping time (nearly all hours of every day), causing accelerated stress damages and increased wear of expendable components, including the fluid ends. Therefore, pump manufacturers are now exploring modifying existing pump models to improve the duty cycle and extend operating life in these harsher environments.

In order to enhance the durability of high pressure pumps, the engineers and researchers need to battle with the fatigue of metals through optimization of the structure and materials. Fatigue is a progressive and localized structural damage process that occurs when a material is subjected to cyclic loading. It is dangerous and unwanted because components could fail under much lower stress than the fracture strength. Fatigue failure processes depend on the cyclic stress state, geometry, surface integrity, residual stress and environment (temperature, air or vacuum or solution), etc. The relationship between fatigue life and the applied stress can be approximately represented by the Basquin Equation:

$$S_a = A \times (N_f)^B$$

Where $S_a$ is the effective alternating stress, $N_f$ is the corresponding cycle number when failure occurs, and A and B are the fitted parameters (A>0 and B<0). When the applied stress $S_a$ increases, the corresponding lasting cycles $N_f$ would decrease. Thus, the higher stress requirements for stimulating shale gas reservoirs accelerate the fatigue damages of pumping systems. In addition, the concept of stress concentration (k), an amplifying factor for applied stress due to geometry effect, is basically related to the likelihood of fatigue and/or stress corrosion cracking of pump housing. The working pressure (P, less than 20,000 psi) in oilfield is much smaller than the endurance limit of high strength steels (e.g., 100,000 psi for 4330 steel); but the effective stress $S_a$ (=k×P) is pretty close to the fatigue limit of steels when the factor k is larger than 5 due to the intersecting geometry of fluid end.

The breakdown of high pressure pumping system can cause significant problems in the oilfield. The downtime for replacement or maintenance of fluid ends at the fracturing site costs the oil service companies tens of thousands of dollars; plus, the users need to have significant excess backup of pumping equipment to ensure continuous operation, which is counter to the current emphasis on shrinking the oilfield footprint. Therefore, the best solution is that pumping products with greater reliability and predictability be provided through technology innovations to meet the challenging requirements. Prior art techniques have included using hand grinding radii at the intersection of the fluid end bores or using obtuse intersecting angle design (e.g., Y-type pump) to reduce the stress concentration. In addition, because the fatigue failure at intersecting bores is initiated from the surface under tension stress, a strategy to counter such failure mechanism is to pre-stress the surface in compression, including "shot peening" at the intersecting port, autofrettage treatment of the whole fluid chamber or using a tension member longitudinally extending through the pump body to apply compressive stress. But none of these prior art techniques have satisfactorily addressed the difficulties. The shot peening-induced compressive layer is too thin to protect the inner surface from "sand erosion." The hydraulic pressure required for the effective "autofrettage" treatment is high (close to 70,000 psi) and has the potential to cause damage inside the chamber.

The present invention relates to reducing the effective stress applied on fluid ends of high pressure plunger pumps through structural changes to thus mitigate or eliminate the fatigue and stress corrosion cracking of high pressure components.

SUMMARY OF THE INVENTION

According to one embodiment of the invention, there is provided a housing for high-pressure fluid applications. The housing comprises a first bore, a second bore and a third bore. The first bore has a first centerline, the second bore has a second centerline and the third bore has a third centerline. The first, second and third bores are oriented such that they intersect at a first chamber, and their centerlines lie in a cross-section plane such that there is a first intersection zone between said first bore and said second bore. The first intersection zone has a first ruled surface.

In accordance with another embodiment of the invention, there is provided a housing for a reciprocating plunger pump. The housing comprises a suction-valve bore, a discharge-valve bore, a plunger bore, an access bore and at least one intersection zone. The suction-valve bore has a substantially circular cross-section for accommodating a circular-suction valve, and a first centerline. The discharge-valve bore has a substantially circular cross-section for accommodating a circular-discharge valve, and a second centerline. The first and second centerlines are collinear or parallel with an offset. The plunger bore has a substantially circular cross-section for accommodating a plunger and seal packing, and a third centerline. The third centerline is coplanar with the first and second centerlines and substantially perpendicular to the first and second centerlines. The access bore has a circular cross-section for accommodating an access bore plug, and a fourth centerline. The third and fourth centerlines being collinear or parallel with an offset. The fourth centerline being coplanar with the first, second and third centerlines and substantially perpendicular to the first and second centerlines. The intersection zone has a ruled surface wherein the intersection zone is located between two of the bores.

In accordance with a third embodiment, there is provided a fluid end for a multiple-cylinder reciprocating pump. The fluid end comprises a housing. The housing has multiple plunger bores, a front plane, a left sidewall and a right sidewall. The multiple plunger bores each have with a plunger-bore centerline wherein the plunger-bore centerlines are parallel and coplanar such there are neighboring plunger bores, and wherein the distance between neighboring plunger-bore centerlines are equal. The front plane is perpendicular to the plunger-bore centerlines. The left sidewall has a left-sidewall thickness and a left side plane, which is substantially perpendicular to the front plane. The right sidewall has a right-sidewall thickness and a right side plane, which is substantially perpendicular to the front plane and opposes said left sidewall plane. The ratio of the left-sidewall thickness and the distance between neighboring plunger-bore centerlines is equal to or greater than 0.6, and wherein the ratio of the right-sidewall thickness and the distance between neighboring plunger-bore centerlines is equal to or greater than 0.6.

BRIEF DESCRIPTION OF THE DRAWINGS

The drawings are provided to illustrate certain aspects of the invention and should not be used to limit the invention.

FIG. 4 shows the formation of ruled surfaces at the intersection zones.

FIG. 9 is a cross-sectional view similar to FIG. 5 but showing an embodiment of the invention using a vertical sidewall at the suction-valve bore.

DETAILED DESCRIPTION OF THE EMBODIMENTS

Figure 1:
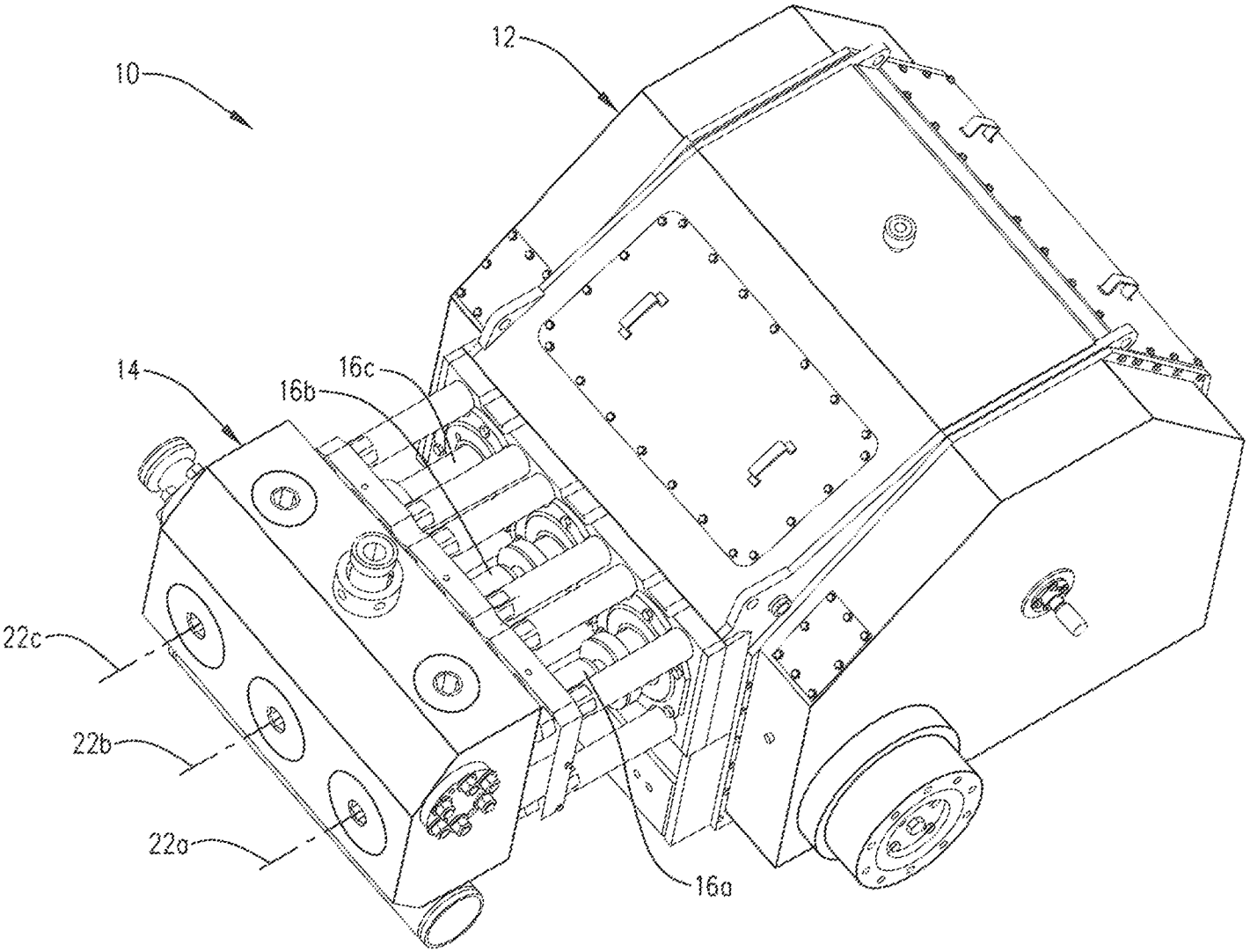
FIG. 1 is a perspective view of a triplex reciprocation plunger pump, which can utilize embodiments of the invention.

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. In the following description, the terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Figure 2:
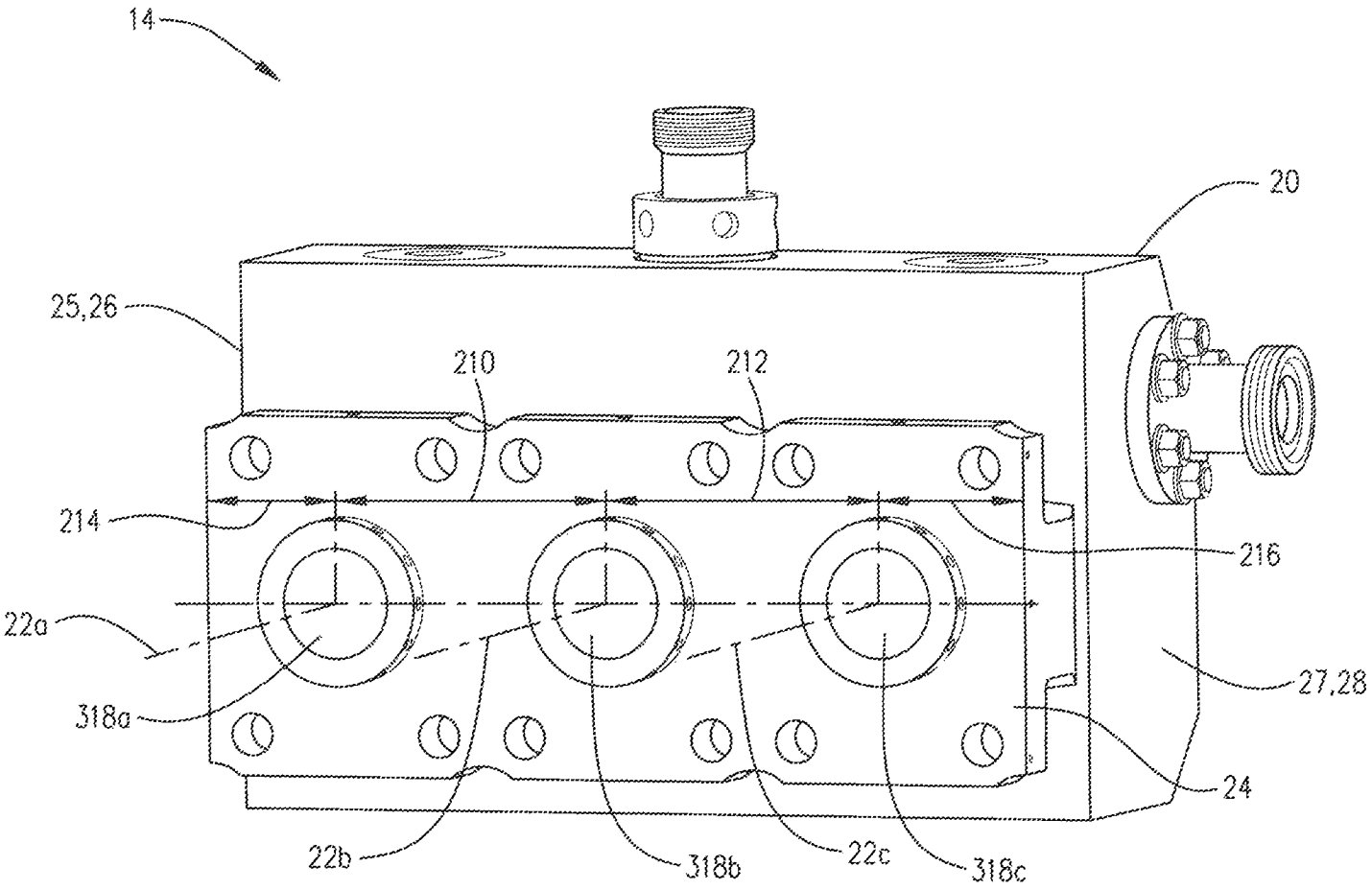
FIG. 2 is an enlarged view of the fluid end of the triplex reciprocating plunger pump of FIG. 1.
Figure 3:
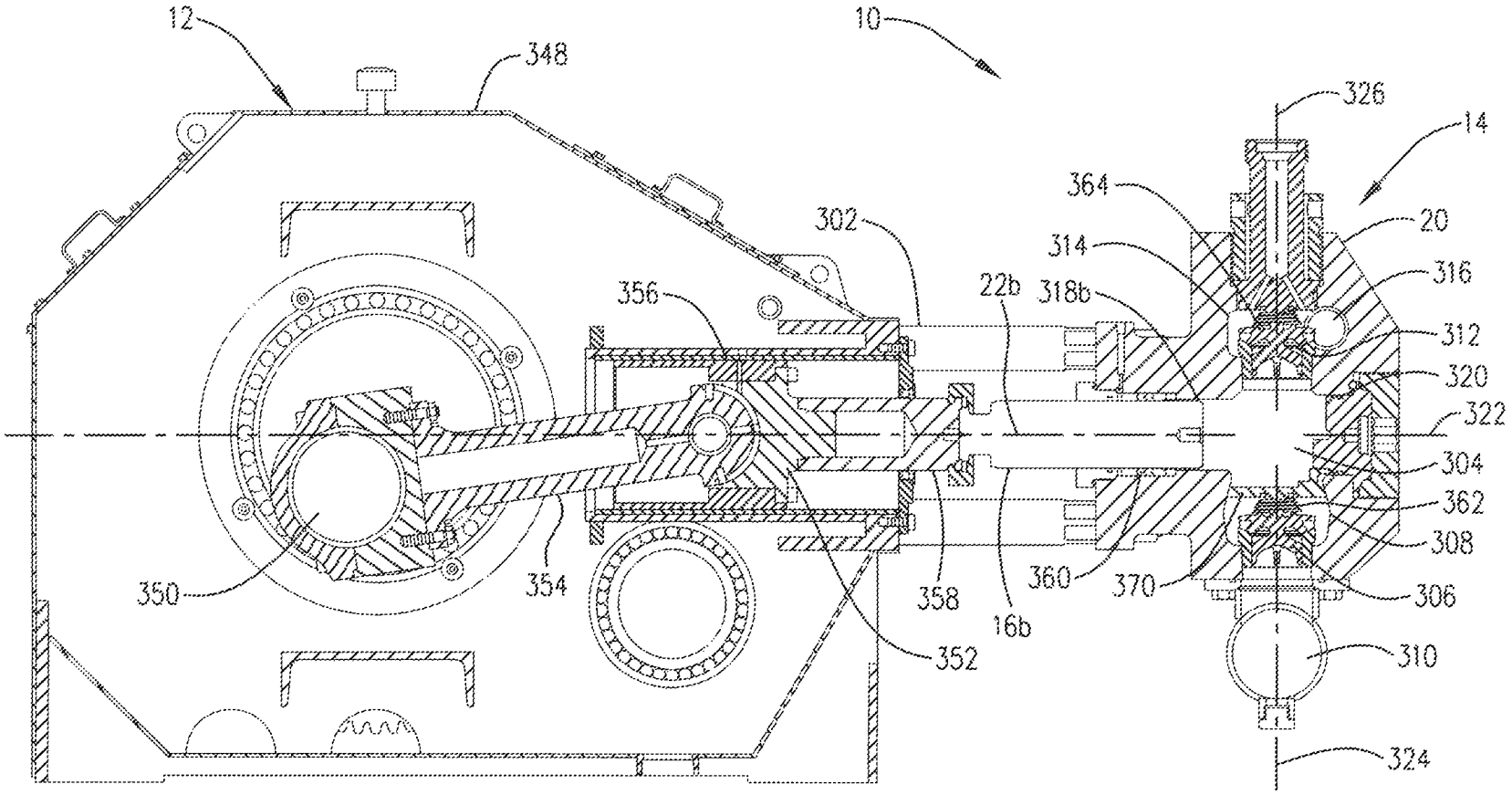
FIG. 3 is a sectional view of a reciprocating plunger pump, schematically illustrating the working mechanism of the power end and fluid end.

FIG. 1 is an exemplary 3D illustration of a reciprocating plunger pump assembly 10 of the present invention, having a power end 12 and a fluid end 14. In the depicted embodiment, the plunger pump assembly 10 is a triplex pump having three plunger cylinders or bores (shown as 318*a*,

318*b* and 318*c* in FIGS. 2 and 3) with centerlines 22*a*, 22*b* and 22*c*, each with a corresponding plunger 16*a*, 16*b* and 16*c*, movably disposed with respect thereto. The triplex plunger pump described herein is representative. The plunger pump assembly 10 may be a pump with any appropriate number of cylinders as discussed further below, such as a five cylinder pump (quintuplex pump). In this invention as described below, the fluid end 14 is geometrically configured to reduce the effective stress during the hydraulic pumping operations, thus mitigating the fatigue failure that occurs inside the fluid end 14.

FIG. 2 is an illustration of the fluid end 14 for a triplex plunger pump in isolation. The fluid end includes a body 20 (also known as pump housing). The body 20 comprises a front plane 24, a left sidewall 25 having left side plane 26, and a right sidewall 27 having a right side plane 28. The three plunger bores 318*a*, 318*b* and 318*c*, terminating on front plane 24 and having centerlines 22*a*, 22*b* and 22*c*, are separately distributed or spaced across front plane 24. The distances from centerline 22*a* to 22*b* and from centerline 22*b* to 22*c* are depicted by 210 and 212, respectively. In addition, the distance between the centerline 22*a* and the left side plane 26 is denoted by the number 214, while the distance between the centerline 22*c* and the right side plane 28 is denoted by the number 216. The distance 210 is usually equal to distance 212, depending on the standard parameters of the crankshaft in the power end 12. Additionally, the distance 214 is usually equal to the distance 216.

FIG. 3 is a detailed 2D illustration of the reciprocating plunger pump assembly 10, having a power end 12 operatively coupled to a fluid end 14 via the stay rods 302. The reciprocating plunger pump assembly 10 is shown in cross-section in FIG. 3. The pump body 20 includes one or more fluid chambers 304. For simplicity, a typical cross-section of such a fluid chamber along center plunger bore 318*b* is shown as representative. As such, any discussion below referring to the fluid end applies to the triplex pump or the quintuplex pump, etc. The pump housing 20 typically includes a suction valve 306 in a suction bore 308 that draws fluid from within a suction manifold 310, a discharge valve 312 in a discharge bore 314 that controls fluid output into a high-pressure discharge port 316, a plunger bore 318 for housing a reciprocating plunger 16*b*, and an access bore 320 to enable or otherwise facilitate access to the plunger bore 318. The centerlines of the plunger bore 318*b* and the access bore 320 are denoted by the number 22*b* and 322. The centerlines 22*b* and 322 could be collinear or parallel with an offset. Also, the centerline 324 of the suction-valve bore 308 and the centerline 326 of the discharge valve bore 314 are collinear or parallel with an offset. Typically, the centerlines 22*b* and 322 are substantially perpendicular to the centerlines 324 and 326; and the four centerlines are coplanar (referred to herein as the "cross-section plane"). Pump housing 20 is designed so that the four cylinders (bores) 308, 314, 318*b* and 320 generally intersect in the vicinity of the fluid chamber 304. This type of intersecting vertical and horizontal bore configuration is preferred because of its compact profile. However, this intersecting bore configuration results in excessive failures by fatigue cracks that are produced at the high stress regions proximate the intersections. Accordingly, in this invention geometrical configurations are disclosed to effectively reduce the stress concentrations at the respective bore intersections, and thus minimizes and/or substantially eliminate fatigue failure that occur due to the alternating high and low pressures in the fluid chamber 304 during each stroke of a plunger cycle.

Also in the embodiment illustrated in FIG. 3, the operation of fluid end 14 is driven by the plunger 16*b* connected with the power end 12. The power end 12 comprises a housing 348 for a crankshaft 350, which is rotated by a gear box including a bull gear and pinion gear (not shown here) through an engine power input. A crosshead 352 is connected to the crankshaft 350 through a connecting rod 354. The crosshead 352 is mounted within a stationary crosshead housing 356, which constrains the crosshead 352 to go forward and back linearly. The plunger 16*b* is connected to the crosshead 352 through a pony rod 358. It thus can achieve the push and pull of the fluid in the chamber 304 through the reciprocating movement of the plunger 16*b*. In some circumstances where the space for the plunger pump assembly 10 is limited, the plunger 16*b* is directly connected to the crosshead 352 without use of any pony rod 358. The plunger 16B reversibly slides along the corresponding plunger bore 318*b* (with seal packing 360 mounted); thus, contributing to the pressure change and volume evolution of fluid in the chamber 304. As the plunger 16*b* moves longitudinally away from the fluid chamber 304 (at the suction stroke), the pressure of the fluid inside the chamber will decrease until a differential pressure is created across the suction valve 306 to overcome the force generated by a suction-valve spring 362; thus, this pressure differential is able to actuate the suction valve 306 and allow the fluid to flow into the fluid chamber 304 from the suction manifold 310. This suction process continues until the plunger 16*b* moves to the dead point where the pressure difference is small enough for suction valve 306 to return to the closed position. As the plunger 16*b* changes to longitudinally move toward the fluid chamber 304 (at the discharge stroke), the hydraulic pressure inside gradually increases until the differential pressure across the discharge valve 312 (high-pressure discharge port 316) is large enough to overcome the force of the discharge-valve spring 364. This enables pumping fluid to exit the fluid chamber 304 via the high-pressure discharge port 316.

In each suction-discharge stroke cycle, the pump housing 20 experiences a stress cycle from low pressure to high pressure. Given a pumping frequency of two (2) pressure cycles per second, the fluid end 14 can experience very large number of stress cycles within a short operational lifespan, such as close to 0.2 million cycles per day. In addition, the pumping fluid can include sand, cement or chemicals within the water. All these operating conditions (cyclic stress coupled with wear and corrosion) induce the fatigue or stress corrosion failure of the fluid end 14. The requirements of expensive repairs and more often replacement of fluid end 14 drive the development of new techniques enhancing the pump resistance of fatigue failure. Prior art techniques have included using hand grinding radii at the intersection of the fluid end bores or using obtuse intersecting angle design (e.g., Y-type pump) to reduce the stress concentration. In addition, because the fatigue failure at intersecting bores is initiated from the surface under tension stress, a strategy to counter such failure mechanism is to pre-stress the surface in compression, including "shot peening" at the intersecting port, autofrettage treatment of the whole fluid chamber or using a tension member longitudinally extending through the pump body to apply compressive stress. But none of these prior art techniques have satisfactorily addressed the difficulties. The shot-peening-induced compressive layer is too thin to protect the inner surface from "sand erosion". The hydraulic pressure required for the effective "autofrettage" treatment is high (close to 70,000 psi) and has the potential to cause damage inside the chamber.

Figure 4:
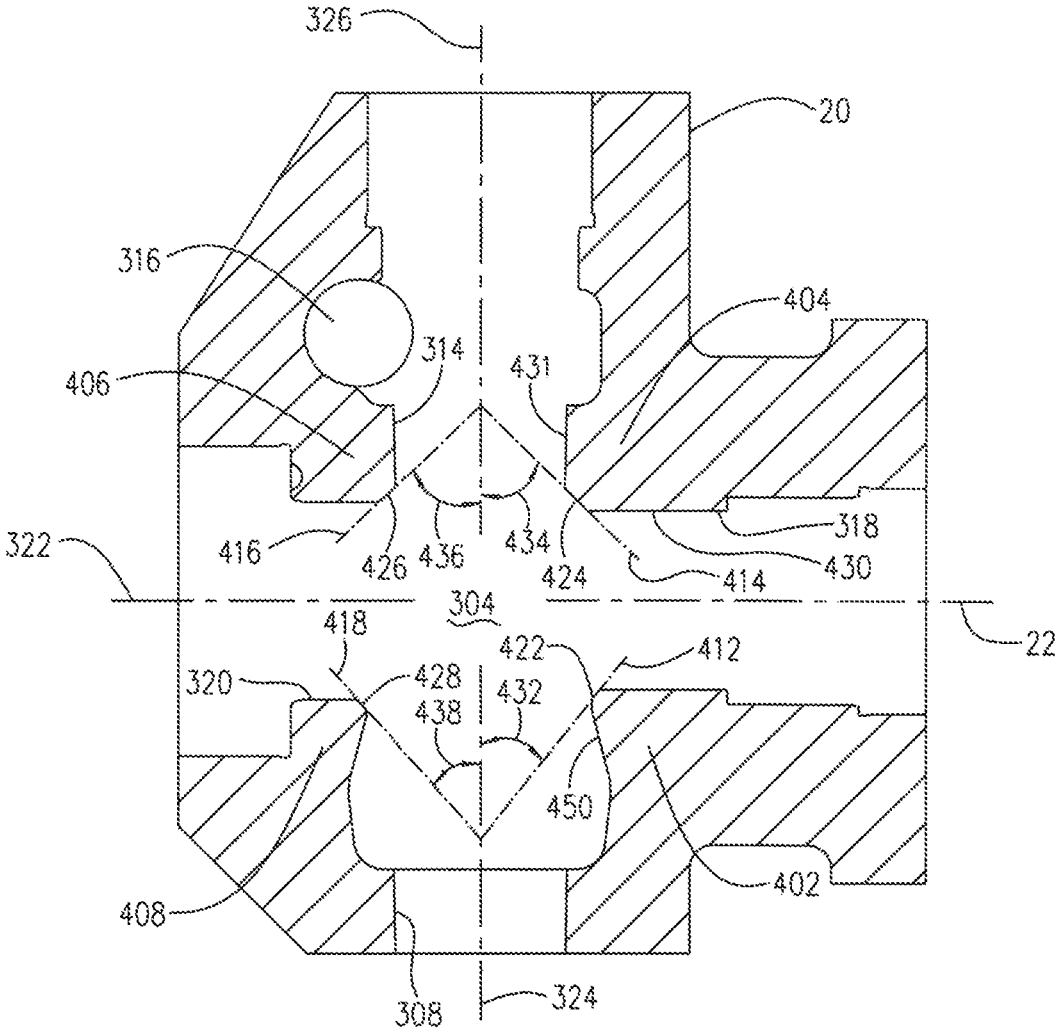
FIG. 4 is a cross-section view of the fluid end pump housing 4 in the cross-section plane, that is the plane defined by the coplanar centerlines of any of the group of intersecting bores of the housing.
Figure 5:
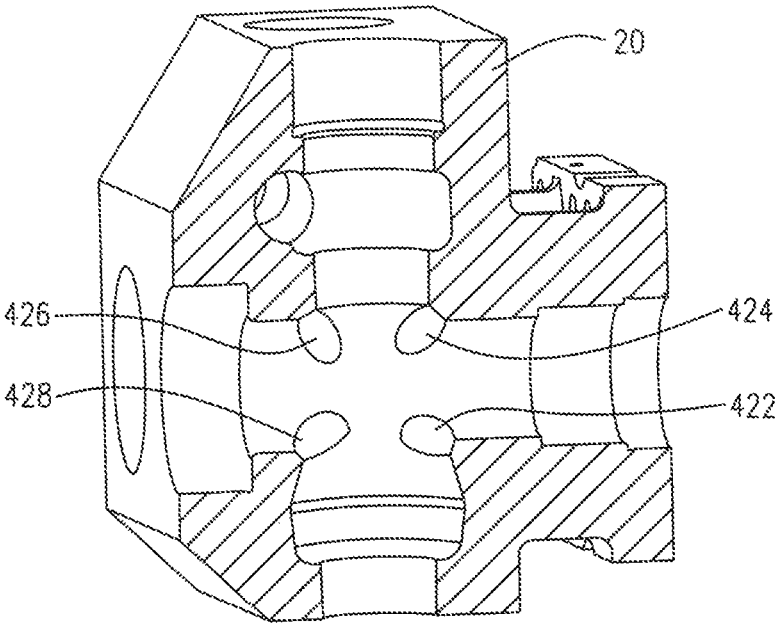
FIG. 5 is a schematic illustration of the ruled surfaces inside the chamber of the fluid end pump housing, which are formed at the intersection transition zones.
Figure 6:
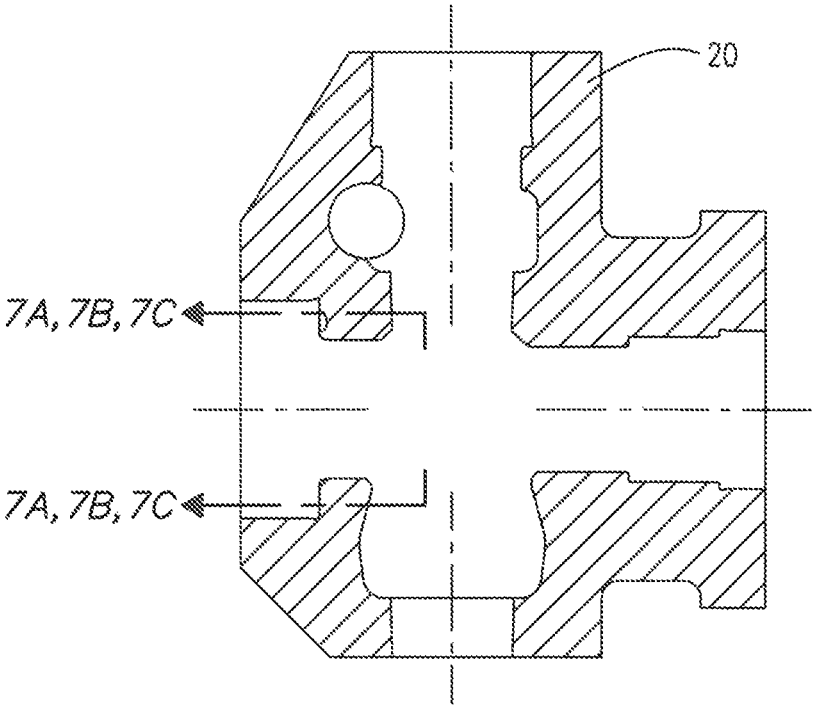
FIG. 6 is a sectional view of the pump housing.

Turning now to FIG. 4, FIG. 5 and FIG. 6, an embodiment of the current invention utilizing a ruled surface at the intersecting bores of pump housing 20 is illustrated. For simplicity, FIG. 4 to FIG. 6 are cross-sectional illustrations of pump housing 20 (without including the accessories such as valves, plungers and seal packing) herein. The illustrated set of intersecting bores is representative of any number of plunger pumps and particularly of triplex, quaduplex (four cylinder pump) or quintuplex plunger pumps. FIG. 4 is a cross-section in the cross-section plane, which is the plane defined by the coplanar centerlines of any of the group of intersecting bores of the pump housing 20. However, the discussion below is applicable to any of the plunger bores and, because of such, the plunger bore and its centerline are referred to below as 318 and 20, respectively, without a sub-designation of a, b or c.

Focusing on FIG. 4, suction valve bore 308 has a centerline 324, parallel to or collinear with the centerline 326 of the discharge-valve bore 314. The horizontal cylinder perpendicular to the vertical cylinder (308 and 314) comprises a plunger bore 318 and an access bore 320, with the parallel or collinear centerlines 22 and 322, respectively. The four centerlines mentioned above are substantially coplanar in the plane of the cross-section illustrated in FIGS. 4 and 6 (the "cross-section plane"). Suction-valve bore 308, discharge-valve bore 314, plunger bore 318 and access bore 320 intersect to form fluid chamber 304. During the suction stroke, the pumping fluid is drawn in through suction-valve bore 308 so that it enters into fluid chamber 304, access bore 320, the plunger bore 318 and the discharge-valve bore 314. During the discharge stroke, the pumping fluid is forced out of fluid chamber 304 through discharge-valve bore 314.

Locations that are normally subject to failure in the fluid end 14 are the intersecting zones between the bores, comprising an intersection zone 402 between the suction bore 308 and the plunger bore 318, an intersection zone 404 between the plunger bore 318 and the discharge bore 314, an intersection zone 406 between the discharge bore 314 and the access bore 320, an intersection zone 408 between the access bore 320 and the suction bore 308. As can be seen from FIG. 4, intersection zones 402, 404, 406 and 408 are portions of the housing or body 20 of fluid end 14; and, thus are comprised of the material of construction of housing 20. As can be further seen, each intersection zone lies adjacent to fluid chamber 304 such that it has a surface exposed to fluid chamber 304. Additionally, intersection zones 402 and 408 can have a radial protrusion 450, which performs as the seat of the suction-valve stop 370 in FIG. 3 to resist the valve being push into the fluid chamber 304 and rotation of the suction valve. As will be understood, radial protrusion 450 generally will extend circumferentially around suction-valve bore 308, and thus extends from intersection zone 402 to intersection zone 408.

Another embodiment is illustrated in FIG. 9, where the suction-valve bore 308 has a vertical sidewall 510 extending circumferentially around the suction bore 308, and hence, from intersecting zone 402 to intersection zone 408. Compared with the case of a radial protrusion in FIG. 4, the stress state for a vertical sidewall can be relatively lower based on finite element analysis results. One skilled in the art will recognize from this disclosure that the design of the valve stop at the suction-valve bore will need to be appropriately designed.

Returning now to FIG. 4, an embodiment is illustrated where ruled surfaces 422, 424, 426 and 428 are introduced to form intersecting transition zones at intersecting zones 402, 404, 406 and 408, respectively. The introduction of ruled surfaces is configured to decrease the stress concentrations (both tensile and compressive stress) at the intersecting zones. Each ruled surface is generally located so as to form at least part of the surface of the intersection zone exposed to fluid chamber 304. Thus, for example, intersection zone 404 is located between plunger bore 318 and discharge bore 314 such that it has a first surface 430 forming part of plunger bore 318, a second surface 431 forming part of discharge bore 314 and a ruled surface 424 exposed to fluid chamber 304. As can be seen from FIG. 4, ruled surface 424 serves as a transition from plunger bore 318 to discharge bore 314 at the intersection of the two bores; and, thus, is an intersecting transition zone.

Ruled surfaces are surfaces formed by an infinite number of ruling lines or straight line segments and may be defined as a straight line moving through space along a predetermined path. Ruled surfaces 422, 424, 426 and 428 are defined by a ruling line sweeping in a curved path (scan curve); or in other words, the scan curve is traced by the ruling line. The ruling line defining a ruled surface remains generally at an angle $\alpha$ from one of the centerlines of the intersecting bores associated with the intersecting zone of the relevant ruled surface. The angle $\alpha$ can typically be from 25° to 65° from the relevant centerline as measured from interior to the fluid chamber. Additionally, the angle $\alpha$ can typically be from 30° to 60°, or from 35° to 55°, from the relevant centerline as measured from interior to the fluid chamber. In FIG. 4, the ruling lines or straight edge lines 412, 414, 416 and 418 are shown as they lie in the cross-section plane and the angle $\alpha$ for each ruling line is shown as angles 432, 434, 436 and 438, respectively.

Figure 7A:
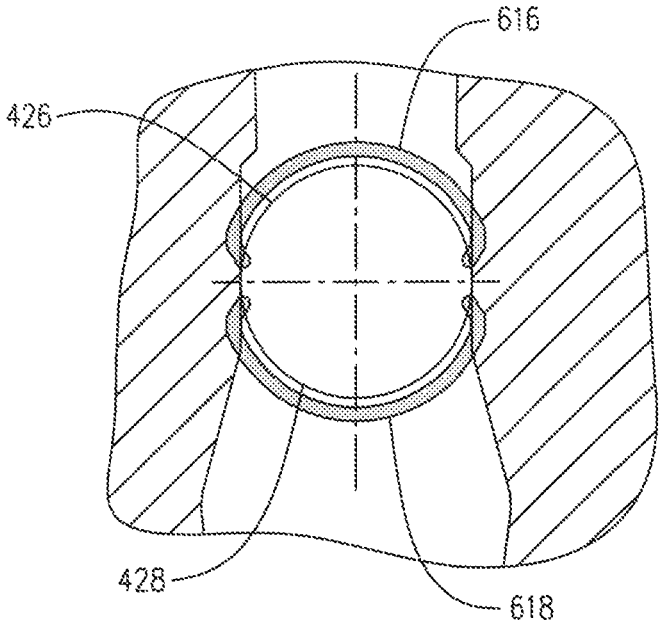
FIG. 7A is a cross-sectional view along line 7A-7A in FIG. 6, showing the curved traces which define the ruled surfaces.
Figure 7B:
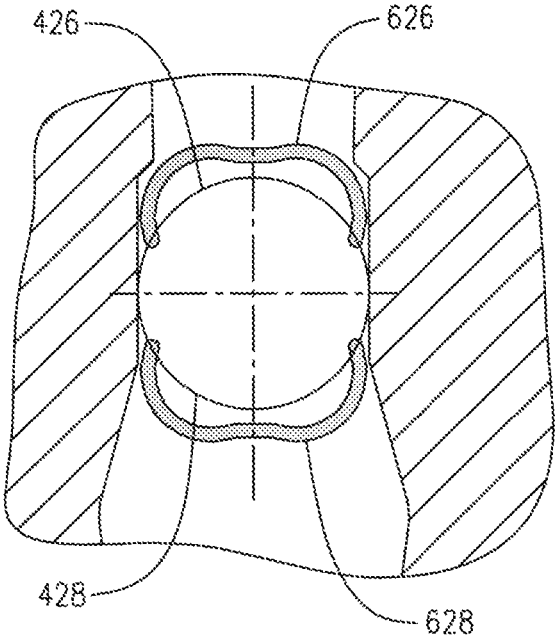
FIG. 7B is a cross-sectional view along line 7B-7B in FIG. 6, showing the curved traces which define the ruled surfaces.
Figure 7C:
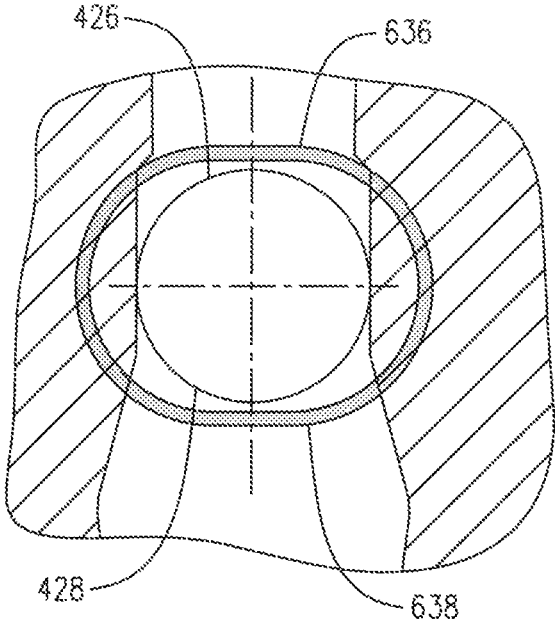
FIG. 7C is a cross-section view along line 7C-7C in FIG. 6, showing the curved traces which define the ruled surfaces.

The scan curve defining the ruled surface is a curve as shown in FIGS. 7A, 7B and 7C. The scan curve lies in a plane perpendicular to the cross-section plane and is located relative to the relevant intersecting zone so as to define a ruled surface at the intersection transition zone when scanned by the associated ruling line. Typically for most fluid end sizes, the scan curve will be positioned within the fluid chamber with a position such that, when scanned, it defines a ruled surface having a width in the cross-section plane from 0.1 to 2 inches. The ruling line can trace the scan curve so as to represent a series of parallel lines defining the ruled surface all having an angle $\alpha$ with the relevant centerline. In some embodiments, the ruling line can trace a scan curve (within the fluid chamber) and the curve of the bore opposing the scan curve. In these embodiments, the ruling lines maintain angle $\alpha$ with the relevant centerline but can vary in their angle to a line perpendicular to the cross-section plane.

As illustrated in FIG. 4, a straight edge line 412, on the cross-section plane having an angle 432 with the centerline 324 of the suction bore 308, is used to scan along a curve (such as those shown in FIGS. 7A, 7B and 7C) and form a ruled surface 422 at the intersection zone 402. A ruled surface 424 is formed at the intersection zone 404 through scanning by a straight edge line 414 having an angle 434 with the centerline 326 of the discharge-valve bore 314, which in the embodiment of FIG. 4 is collinear with centerline 324 of the suction bore 308. Another ruled surface 426 is formed at the intersection zone 406 through scanning by a straight edge line 416 having an angle 436 with the centerline 326. Another ruled surface 428 is formed at the intersection zone 408 through scanning by a straight edge line 418 having an angle 438 with the centerline 324. The angles 432, 434, 436, 438 between the straight edge lines 412, 414, 416, 418 and the centerlines 324, 326 are all between 25° and 65°. The effect of the ruled surface on reducing the stress at the intersection zones strongly depends on the scanning trace, examples of which are illustrated in FIGS. 7A, 7B and 7C.

Figure 8:
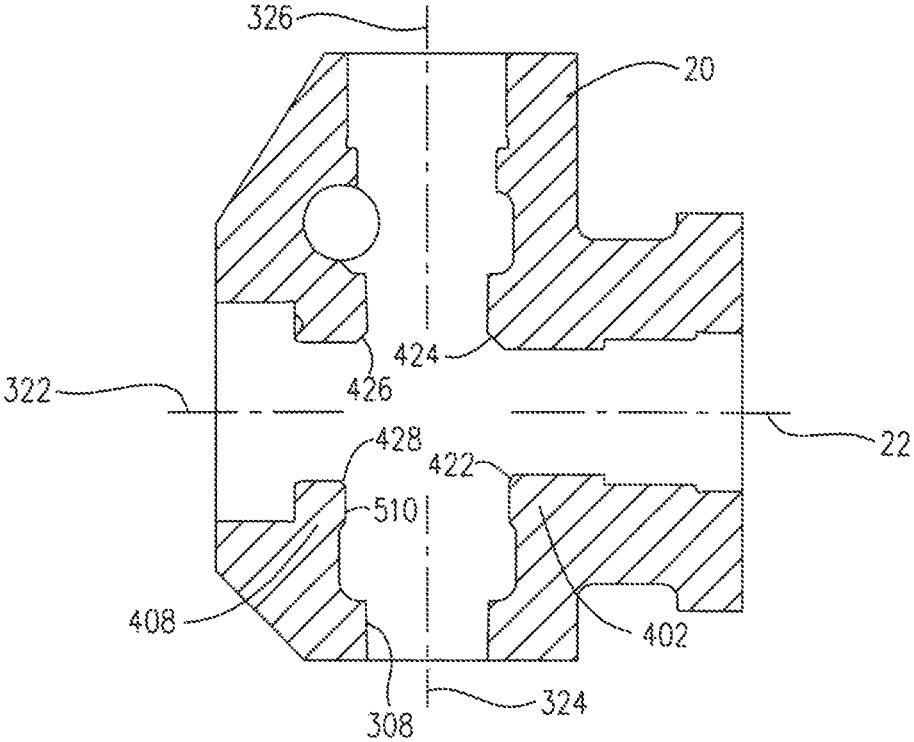
FIG. 8 is a perspective with a partial sectional view of a pump housing in accordance with an embodiment.
Figure 8:
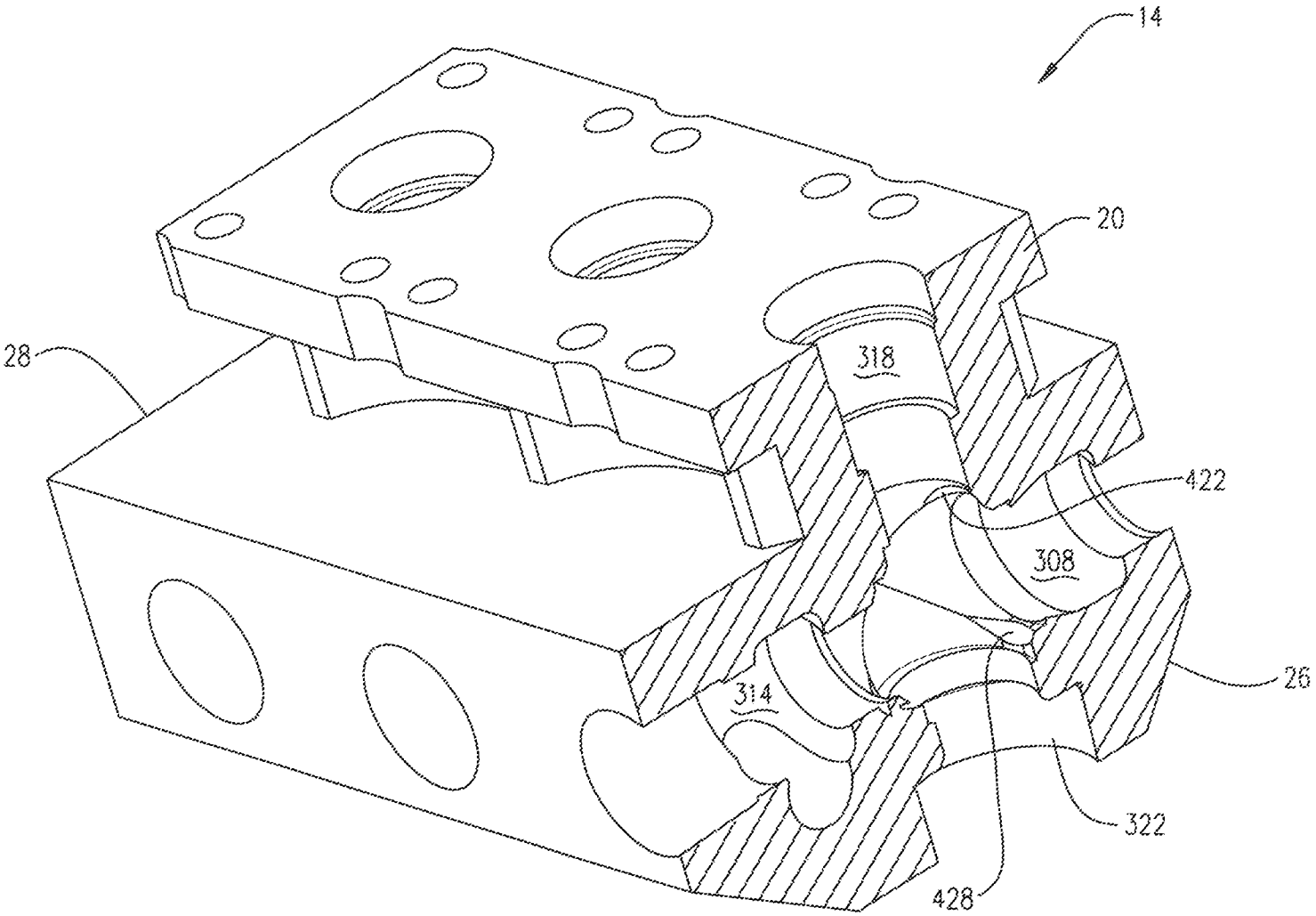

FIG. 5 and FIG. 8 are 3D demonstration of the formed ruled surfaces at the intersecting transition zones in the pump housing 20, as denoted by the number 422, 424, 426 and 428. These ruled surfaces at the transition zones effectively increase the area at the intersecting transition zone to better sustain the hydraulic pressure, thus decreasing the stress concentration at the intersection zones. Although some benefit may be achieved by simply introducing a ground surface as an intersection transition zone, the current invention rests on the discovery that introducing a ruled surface as an intersection transition zone greatly enhances the life of the fluid end 14 by reducing stress and/or increasing stress tolerance.

FIGS. 6 and 8 are pump housing 20 with ruled surfaces at the intersecting transition zones. Several kinds of scan curves can be employed for developing the ruled surfaces, as depicted in FIGS. 7A, 7B and 7C. Note that though specific description of the invention has been disclosed herein in some detail, this is not limited to those implementation variations which have been suggested herein. FIGS. 7A, 7B and 7C are shown on a cross-section view along the line 7A-7A, 7B-7B, 7C-7C of FIG. 6. In an embodiment as shown in FIG. 7A, a typical scanning trace is along a scan curve that is a partial circular curve indicated by the number 618 for the machining of the ruled surface 428 at the intersection zone 408 between suction bore 308 and access bore 320, and by the number 616 for the machining of the ruled surface 426 at the intersection zone 406 between discharge bore 314 and access bore 320. The other two scanning traces could have similar or different profiles for the formation of ruled surfaces at the intersecting ports.

In another embodiment as shown in FIG. 7B, a typical scanning trace is along a curve composed by two intersecting partial circular curves (arcs) denoted by the number 628 for the machining of the ruled surface 428 at intersection zone 408, and by the number 626 for the machining of the ruled surface 426 at intersection zone 406. The other two scanning traces could have similar or different profiles for the formation of ruled surfaces at the intersecting ports.

In a further embodiment as shown in FIG. 7C, a typical scanning trace is along an oblong curve composed by two separated semicircles (or partial arcs) with a straight connecting line, denoted by the number 638 for the machining of the ruled surface 428 at intersection zone 408, and by the number 636 for the machining of the ruled surface 426 at intersection zone 406. The other two scanning traces could have similar or different profiles for the formation of ruled surfaces at the intersecting ports.

Note that besides introducing the ruled surfaces into the intersecting transition zones, the transition zones between the new ruled surfaces and existing intersecting bores could be chamfered to smooth the transition in some cases. That is, the ruled surfaces, formed by a line tracing along a specific curve, could be evolved into some geometries showing some extent of modification of the line or traced curve, e.g., the original straight ruling line evolves into a "curved" line to some extent or the traced curve deviates from the standard geometry a little bit.

Figure 10:
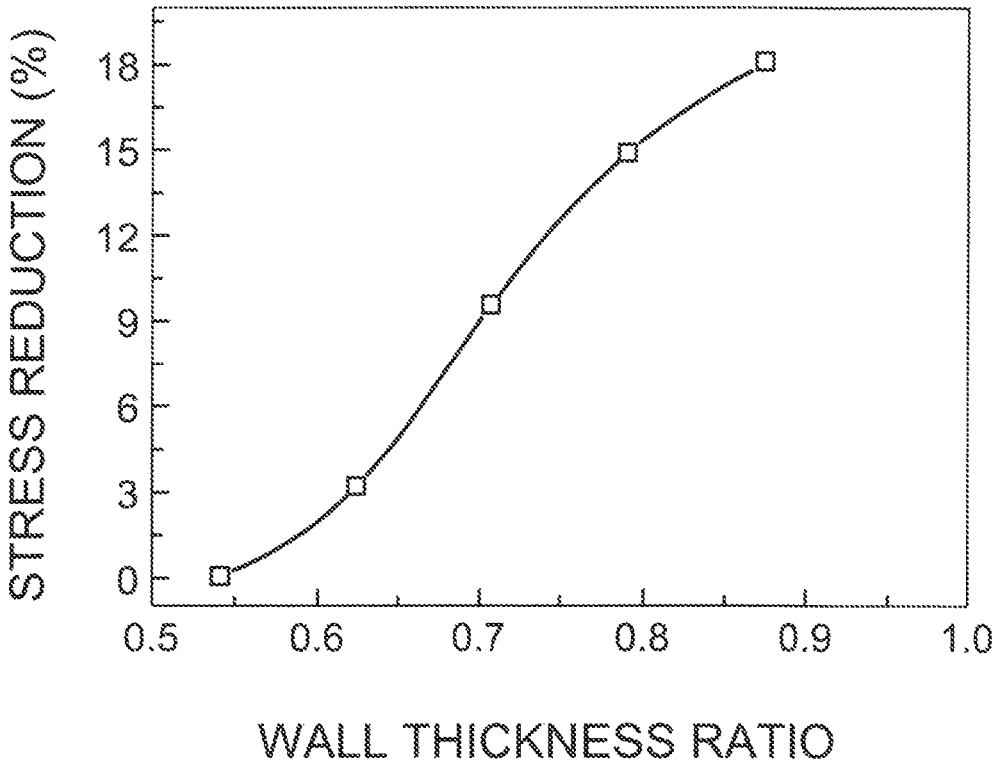
FIG. 10 is a graph of the stress in the sidewall cylinder hole verses the length of the fluid in housing (changed by increasing the sidewall width).

In another embodiment of this invention, the sidewall confinement of the fluid end 14 is enhanced. Prior art techniques have developed an "autofrettage" treatment and applying compressive stress through a tension bar to enhance the resistance of fatigue failure. These methods both need to redesign the structure of the fluid end; and their effectiveness strongly depends on some treating parameters, such as the hydraulic pressure to induce internal plastic deformation of pump housing or the applied torque to control the compressive stress. Referring now to FIG. 2, an improvement in the fluid end 14 design, which protects the housing 20 against fatigue, will be now described. The improvement is supported by systematic finite element analysis, which shows the sidewall thickness effect on the stress concentration. As shown in FIG. 2, the centerlines 22*a*, 22*b* and 22*c* of the plunger bores, from the left to the right on the front plane, are coplanar. The distance 210 between the centerlines 22*a* and 22*b* (also known as wall thickness) and the distance 212 between centerlines 22*b* and 22*c* are usually equal. The distance 214 from the left centerline 22*a* to the left side plane 26 of left sidewall 25 (known as the sidewall thickness) and the distance 216 from the right centerline 22*c* to the right side plane 28 of right sidewall 27 are normally proportional to the distance 210 and 212. Note that the wall thickness here mentioned is a nominal thickness without subtracting the plunger or suction bore size. For conventional high pressure pumping housing, the ratio between distance 214 and 210 is very close to 0.4-0.6, that is, the sidewall thickness is close to half of the wall thickness between plungers of the fluid end 14. In an embodiment of the invention, a larger sidewall thickness is employed where a ratio between the sidewall thickness 214, 216 and the wall thickness between plunger bores 210, 212 is above 0.6. Typically, the ratio of sidewall thickness to wall thickness between plunger bores can be within the range from above 0.6 to about 1.0 and can be within the range of from 0.7 to about 0.86. As illustrated by FIG. 10, for a conventional triplex housing having an overall length of 37 inches and sidewall thicknesses that are about 50% of the wall thickness, the maximum stresses are located on the intersecting transition zones of both side chambers and closely reach a value of 72,000 psi; but at the same time, the maximum stress in the middle bore is pretty close to 20% lower (approximately 58,000 psi). The stress in the two side bores decreases with increased sidewall thickness in a non-linear manner such that it equals the center bore stress when the sidewall thickness equals approximately 126% of the wall thickness. As can be seen from FIG. 10, there is a previously unrecognized and surprising reduction in stress achieved by having a side wall thickness to wall thickness ratio of greater than 0.6. Notice from FIG. 10, it can be seen that at a ratio of about 0.86 the sidewall stress is reduced approximately 18%. Accordingly, there is a previously unrecognized and surprising advantage in increasing the sidewall thickness to wall thickness ratio to be above 0.5, and preferably above 0.6.

The inventive aspects described herein can also apply to other multi-cylinder pumping housing, such as quintuplex fluid end. The use of thicker sidewall in the pumping housing could also be applied to the Y-type fluid end housings (not shown in the figures of this invention), comprising intersecting suction valve bore, plunger bore and discharge valve bores with obtuse angles. In addition, from the manufacturing and cost saving aspects, the outside walls 25 and 27 of the pump housing 20 could be a normal flat plane as shown in FIG. 2; but they could also be modified into specific geometries, with partial of the wall surface being removed. And the increase of the sidewall thickness can also be achieved through adding external steel blocks on both sides of the current housing 20, mounted by screws or welding.

Other embodiments will be apparent to those skilled in the art from a consideration of this specification or practice of the embodiments disclosed herein. Thus, the foregoing specification is considered merely exemplary with the true scope thereof being defined by the following claims.

What is claimed is:

1. A fluid end for a multiple-cylinder reciprocating pump, the fluid end comprising:

a housing having:

at least three plunger bores, each with a plunger-bore centerline wherein the plunger-bore centerlines are parallel and coplanar such there are neighboring plunger bores, and wherein the distance between neighboring plunger-bore centerlines are equal;

a front plane perpendicular to the plunger-bore centerlines;

a left sidewall having a left-sidewall thickness and a left side plane, which is substantially perpendicular to the front plane; and a right sidewall having a right-sidewall thickness and a right side plane, which is substantially perpendicular to the front plane and opposes said left sidewall plane, wherein the ratio of the left-sidewall thickness and the distance between neighboring plunger-bore centerlines is from 0.6 to 1.0, and wherein the ratio of the right-sidewall thickness and the distance between neighboring plunger-bore centerlines is from 0.6 to 1.0.

2. The fluid end of claim 1, wherein the ratio of the left-sidewall thickness and the distance between neighboring plunger-bore centerlines is from 0.7 to 0.86, and wherein the ratio of the right-sidewall thickness and the distance between neighboring plunger-bore centerlines is from 0.7 to 0.86.

3. The fluid end of claim 1, further comprising multiple suction-valve bores each with a suction-valve-bore centerline, and multiple discharge-valve bores, each with a discharge-valve-bore centerline wherein each of the plunger bores intersects with one of the suction-valve bores and one of the discharge-valve bores, such that the suction-valve-bore centerline, discharge-valve-bore centerline and the intersecting plunger-bore centerline lie in a cross-section plane and are parallel with the left and right side planes.

4. The fluid end of claim 3, further comprising a first intersection zone between the suction-valve bore and the plunger bore and a second intersection zone between the discharge-valve bore and the plunger bore, said first intersection zone having a first ruled surface, said second intersection zone having a second ruled surface and wherein said ruled surfaces reduce the stress and thus extends the life of the housing.

5. The fluid end of claim 4, wherein each said ruled surface is defined by a first scan curve traced by a first line, wherein said first line lies parallel to said cross-section plane and is at an angle $\alpha$ to said first centerline, and wherein said first scan curve lies perpendicular to said cross-section plane.

6. The fluid end of claim 5, wherein the angle $\alpha$ is from about 25° to about 65°.

7. The fluid end of claim 6, wherein the ratio of the left-sidewall thickness and the distance between neighboring plunger-bore centerlines is from 0.7 to 0.86, and wherein the ratio of the right-sidewall thickness and the distance between neighboring plunger-bore centerlines is from 0.7 to 0.86.

* * * * *